United States Patent [19]

Burggrabe

[11] Patent Number: 4,502,643

[45] Date of Patent: Mar. 5, 1985

[54] HOUSEHOLD GRIST MILL

[76] Inventor: A. Hilmar Burggrabe, D-7031 Aidlingen, Kirschhalde 1, Fed. Rep. of Germany

[21] Appl. No.: 403,034

[22] Filed: Jul. 29, 1982

[30] Foreign Application Priority Data

Aug. 1, 1981 [DE] Fed. Rep. of Germany ..... 3130519

[51] Int. Cl.[3] ..... B02C 7/12

[52] U.S. Cl. ..... 241/257 R; 241/259.3; 241/261.3; 241/296

[58] Field of Search ..... 241/251, 253, 257 R, 241/259, 259.3, 261.2, 261.3, 296, 298, 297

[56] References Cited

U.S. PATENT DOCUMENTS

| | | | |
|---|---|---|---|
| 7,630 | 9/1850 | Draper | 241/261.3 |
| 891,050 | 6/1908 | Durham | 241/261.3 |
| 1,670,714 | 5/1928 | Craig . | |
| 1,969,899 | 8/1934 | Nielsen | 241/259 X |
| 2,478,937 | 8/1949 | Niethamer . | |
| 2,537,570 | 1/1951 | Bossert | 241/296 |
| 3,688,996 | 9/1972 | Kuest . | |
| 4,039,153 | 8/1977 | Hoffman | 241/261.2 X |
| 4,057,194 | 11/1977 | Orton | 241/261.2 X |
| 4,081,146 | 3/1978 | Yagi | 241/259.3 X |

FOREIGN PATENT DOCUMENTS

| | | | |
|---|---|---|---|
| 29476 | 4/1884 | Fed. Rep. of Germany . | |
| 240737 | 11/1910 | Fed. Rep. of Germany . | |
| 368126 | 2/1923 | Fed. Rep. of Germany . | |
| 1896841 | 7/1964 | Fed. Rep. of Germany . | |
| 2202798 | 8/1973 | Fed. Rep. of Germany . | |
| 2436482 | 2/1976 | Fed. Rep. of Germany . | |
| 2444152 | 3/1976 | Fed. Rep. of Germany | 241/261.2 |

*Primary Examiner*—Mark Rosenbaum
*Attorney, Agent, or Firm*—Wigman & Cohen

[57] ABSTRACT

A household grain mill includes a mill in which the grinding surfaces of the millstones (18, 20) are provided with recesses (28) which extend from the inside toward the outside with decreasing depth and which crack grain fed through a central opening and lead it to an outer grinding zone. The recesses (28) have an asymmetrical cross-sectional shape with two flanks (34, 36), of which the leading flank (34) is steeper than the trailing flank (36) and, together with the flatter flank (36) of the preceeding recess (28), forms an edge (38) which runs tangentially to the periphery of the central opening.

9 Claims, 3 Drawing Figures

HOUSEHOLD GRIST MILL

BACKGROUND OF THE INVENTION

1. Field of the Invention

The invention relates to a household grain mill having two annular millstones, one of which is connected to rotate with a drive shaft and has a plurality of recesses (known in the mill trade as depressions) uniformly distributed about the shaft axis, the depth of which decreases as they proceed radially outwardly and which perform the initial cracking of the grain introduced through the central opening in one millstone and lead the grain into a milling zone formed by parallel, radially outward surfaces of the two millstones, which surfaces run perpendicularly to the axis of the shaft around the depressions.

2. Description of the Prior Art

Mills having millstones of the above type are known. The grinding systems of known household grain mills have the disadvantage that only relatively dry, low-fat grains can be ground with satisfactory results.

SUMMARY OF THE INVENTION

The object of the invention, therefore, is to create a household grain mill which satisfactorily grinds grains independently of their moisture and their fat content and also does not require a high speed drive. This object is achieved according to the invention in that the recesses are formed with an asymmetric cross-sectional shape having two flanks, one of which—the one preceeding the other in the relative rotation of the millstone—is steeper than the other, has a flatter flank and together with the flatter flank of the preceeding recess, form's an edge running tangentially to the periphery of the opening of the one millstone.

In this manner it is advantageously achieved that, with the use of the mill according to the invention, even moist and fatty grains can be well ground at low rpms of the drive shaft, as tests with the exemplary embodiment have shown.

In a preferred embodiment of the mill according to the invention, both millstones are arranged one above the other coaxially to a vertical axis and the upper millstone is provided with the central opening, so that the centrifugal forces can be effective during grinding, undisturbed by gravity.

In the preferred embodiment, one of the two millstones is mounted so as to be axially movably and spring biased, so that the minimum distance of the two millstones from each other, which can be adjusted in any known manner, is automatically increased if the material to be ground contains small stones, for example, which are larger than the grains to be ground. In such a case the mill experiences no damage. The above mentioned minimum distance limits the heat accumulation during grinding and thus aids in not overworking the material to be ground.

BRIEF DESCRIPTION OF THE DRAWINGS

The invention is described in greater detail below with the aid of the preferred embodiment of the mill according to the invention illustrated by way of example in the drawings.

Shown are.

DESCRIPTION OF THE PREFERRED EMBODIMENT

Figure 1:
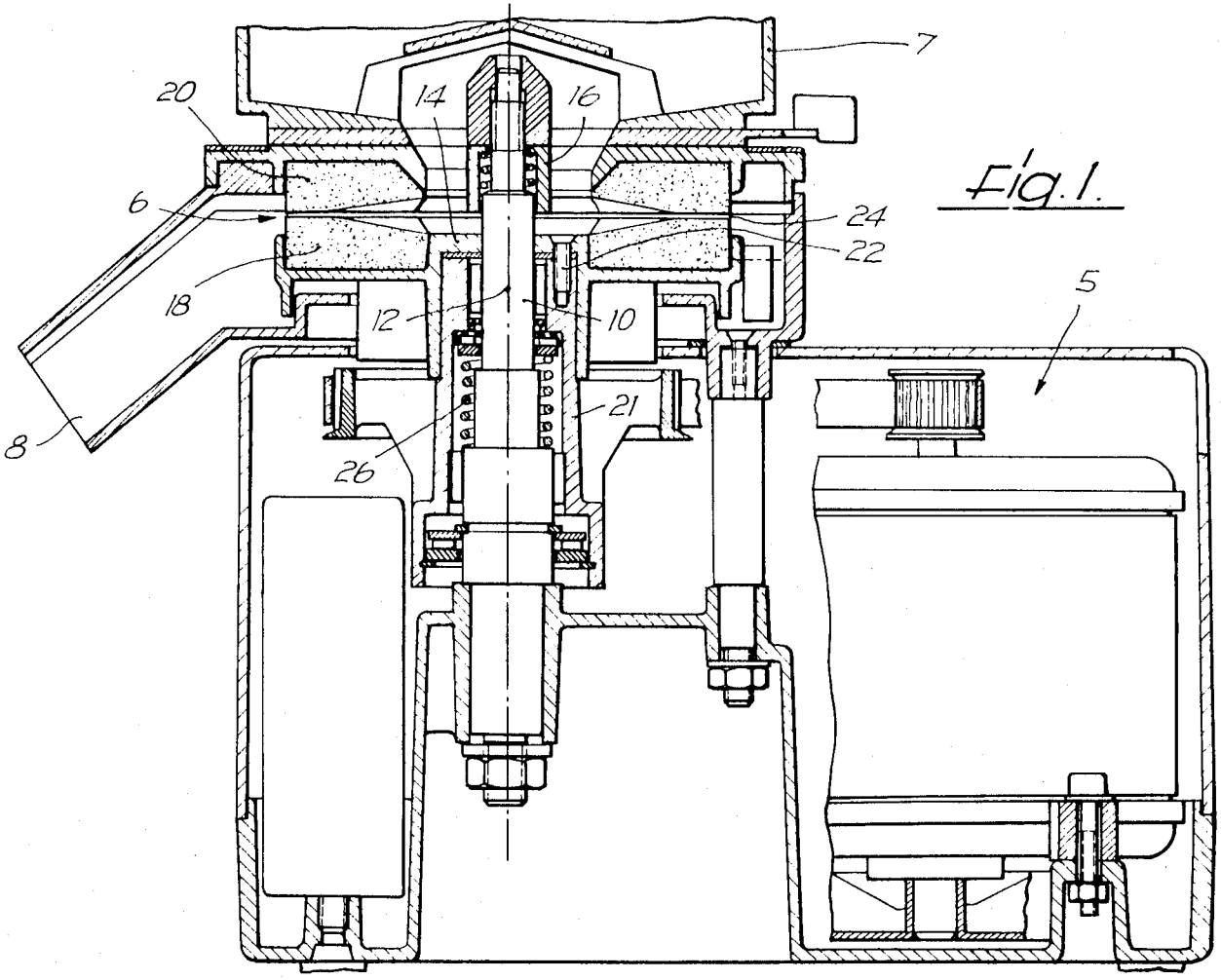
FIG. 1, a central vertical section through a household grain mill with the exemplary embodiment.

The mill consists primarily of a drive 5, which includes an electric motor and a toothed belt drive within a housing, a mill 6 in the preferred embodiment, a funnel 7 for feeding in the material to be ground and a flour or powder discharge 8.

The mill 6 includes a stationary axle 10 with a vertical longitudinal axis 12, which carries two hubs 14 and 16 of a lower millstone 18 and upper millstone 20. The lower hub 14 of the rotatable millstone 18 sits on a hollow drive shaft 21 so as to rotate therewith, said hollow drive shaft 21 coaxially surrounding the stationary axle 10, while the upper hub 16 of the quasi-stationary upper millstone 20 is mounted on the stationary axle 10 for the purpose of centering. The upper hub 16 has openings so that grain can pass out of the funnel 7 into the area between the two millstones 18 and 20. In contrast, the lower hub 14, after screws 22 are in place, has no openings, so that grain cannot fall out.

The width of the opening 24 between the two millstones 18 and 20 can be adjusted in accordance with the grain size by an axial adjustment of the upper millstone 20, which is rotatably mounted for this purpose. The lower millstone 18 is axially movable and is mounted by a spring 26, which provides an upper limit on the axial grinding pressure.

Figure 2:
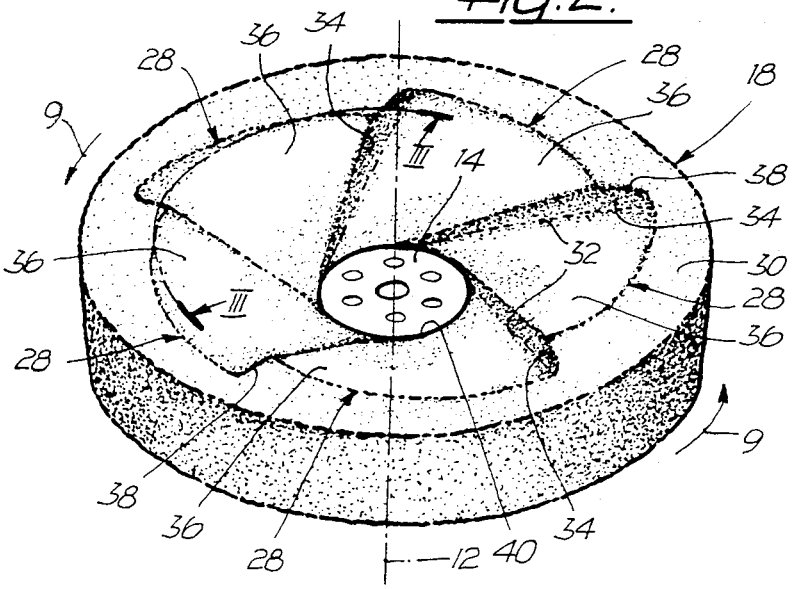
FIG. 2, a perspective view of a mill stone of the exemplary embodiment, whereby the dots are a medium of illustration and say nothing about the roughness of the stone.
Figure 3:
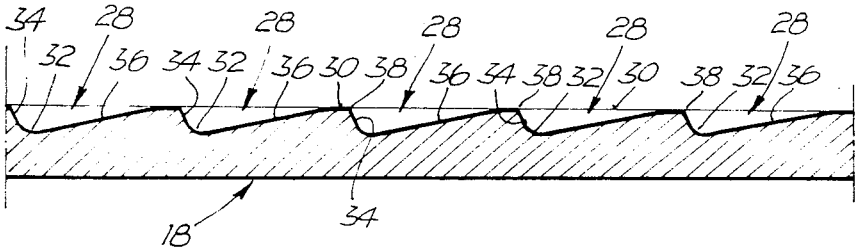
FIG. 3, an unwound or straight representation of a section along the circular line, partially illustrated in FIG. 1 by the arc III—III.

The lower millstone 18, shown in FIG. 2 with its lower hub 14, is generally formed as a circular disc-like ring and consists of finely crystallized primitive emery stone bonded with baked magnesite stone. On its upper side facing the upper millstone 20, the lower millstone 18 is provided with five recesses or depressions 28 uniformly distributed about the shaft axis 12, the depth of which decrease as they proceed radially outward and which are surrounded by a radially outward ring surface 30, which lies in a plane passed through perpendicularly by the shaft axis 12. Each of the identical depressions 28 has an asymmetrical cross-sectional shape which is rounded at its base 32 (see FIG. 3), with a stepper flank 34 which is the leading flank in the rotational direction 9 of the drive shaft 21 and with a trailing flatter flank 36, whereby the trailing flank 36 of a preceeding depression 28 ends at the leading flank 36 of the following depression 28 along an edge 38. The axial projection of this edge 38 runs tangentially to the radial inner periphery of the millstone 18 on a plane passed through peripendicularly by the shaft axis 12, for example, the plane of the ring surface 30. The leading and trailing flanks 34, 36 of the depression 28 are arranged partially inside and partially outside of a concave conical surface, the conical axis of which is the shaft axis 12, and the radially inward ends of said flanks 34, 36 end at a smooth ring edge 40. The upward limitation of the upper side of the millstone 18 by the above mentioned concave conical surface comes about in that a conical recess is turned during manufacture of the compression tool for the millstone 18. As shown in FIG. 2, the trailing flatter flanks 36 of the depressions 28 have the approximate shape of circular sections which fan out about the lower hub 14.

The upper millstone 20 is formed exactly like the described lower millstone 18, although it could be shaped differently, for example with azimuthally shortened sides 36 and without stopping the edge 38 at the inner periphery of the upper millstone 20.

The two ring surfaces 30 of the two millstones 18 and 20, which are opposite and parallel to each other at the opening 24, form a grinding zone in which the grain which has fallen through the upper hub 16 onto the lower hub 14 is subjected to the influence of inertial and frictional forces after preliminary cracking by the depressions 28.

To increase the centrifugal force during grinding, both millstones 18 and 20 can be driven in the same rotational direction at different speeds of revolution.

The foregoing preferred embodiment is considered as illustrative ionly. Numerous other modifications and changes will readily occur to those skilled in the pertinent art.

I claim:

1. A household grain mill, comprising:

two circular millstones mounted on a common axis in opposing relation with each other, each of said millstones having a central opening, at least one of said openings being provided for feeding grain between said millstones, at least one of said millstones being mounted so as to rotate in a direction relative to the other of said millstones about said axis, and at least one of said millstones being mounted so as to be axially movable against a bias force of a spring;

each of said millstones having a ringlike grinding surface, said grinding surface of at least one of said millstones having an annular concave inner portion surrounded by an annular, planar outer portion, said annular inner portion connecting said central opening with said annular outer portion, which together with a planar annular outer surface of the other of said millstones forms an outer grinding zone, said annular, concave inner portion includes less than two recesses in each quadrant of said portion, said recesses each having a leading and a trailing flank in the rotational direction and being uniformly distributed about the common axis next to one another such that adjacent flanks of adjacent recesses form common edges, said trailing flanks of said recesses form the majority of said annular inner portion of said grinding surface.

2. The household grain mill, according to claim 1, wherein said imaginary concave surface is a truncated conical surface.

3. The household grain mill, according to claim 1, wherein said two millstones are arranged one above the other, said common axis is vertically oriented, said central opening of said millstone arranged above the other is open for feeding grain between said grinding surfaces, and said central opening of said other millstone is closed by a hub means.

4. The household grain mill, according to claim 3, wherein:

said one millstone arranged above the other is mounted so as to be adjusted and fixed along the common axis.

5. The household grain mill, according to claim 3, wherein both of said millstones are formed identically, said hub means being connected with a drive shaft so as to rotate therewith and yet being capable of being shifted axially away from the other millstone against said bias force.

6. The household grain mill, according to claim 1, further comprising a hub means for closing the central opening in said one of the millstones; drive shaft means arranged along the common axis for carrying the hub means so that it rotates therewith, and spring means arranged along the common axis for producing said bias force.

7. The household grain mill, according to claim 1, wherein:

said two flanks of each of the plurality of recesses merge into each other at a rounded base.

8. The household grain mill, according to claim 1, wherein:

said two millstones are driven in a common rotational direction at different speeds of rotation.

9. A household grain mill, comprising:

two circular millstones mounted on a common axis in opposing relation with each other, each of said millstones having a central opening, one of said openings being provided for feeding grain between said millstones, one of said millstones being mounted so as to rotate in a direction relative to the other of said millstones about the common axis, and at least one of said millstones being axially movable against a spring bias force;

said millstones each having a ringlike grinding surface, said grinding surface of at least one of said millstones having an annular concave inner portion surrounded by an annular planar outer portion, said annular inner portion being connected to said central opening and said annular outer portion, said annular outer portions of both millstones form an outer grinding zone;

said annular concave inner portion includes recesses having a leading and a trailing flank in the rotational direction and being uniformly distributed next to one another about the common axis so that the adjacent flanks of adjacent recesses form common raised edges lying in said concave inner portion, the leading flank of each of said recesses being steeper than the trailing flank such that the trailing flanks form the majority of said annular inner portions of said grinding surfaces.

* * * * *